US007958603B2

(12) United States Patent
Franco et al.

(10) Patent No.: US 7,958,603 B2
(45) Date of Patent: Jun. 14, 2011

(54) ROTARY HANDLE FOR A CLOSING MECHANISM OF A SASH OF A WINDOW OR THE LIKE AND METHOD FOR ACTUATING A CLOSING MECHANISM

(75) Inventors: Gonzalo Rivera Franco, Cardedeu-Barcelona (ES); Francisco Cãnas Diaz, Martorelles-Barcelona (ES)

(73) Assignee: Roto Frank AG, Leinfenden-Echterdingen (DE)

( * ) Notice: Subject to any disclaimer, the term of this patent is extended or adjusted under 35 U.S.C. 154(b) by 303 days.

(21) Appl. No.: 12/221,786

(22) Filed: Aug. 5, 2008

(65) Prior Publication Data

US 2009/0044379 A1 Feb. 19, 2009

(30) Foreign Application Priority Data

Aug. 15, 2007 (EP) ..... 07016030

(51) Int. Cl.
*A45C 3/00* (2006.01)

(52) U.S. Cl. ..... 16/412; 16/429; 292/202; 74/545

(58) Field of Classification Search ..... 16/412, 16/429, 110.1; 292/202, DIG. 31; 74/545–547, 74/557; 49/324, 279, 339
See application file for complete search history.

(56) References Cited

U.S. PATENT DOCUMENTS 5,230,290 A * 7/1993 Crossman ..... 108/147
5,400,473 A * 3/1995 Delman ..... 16/429
5,450,734 A * 9/1995 Esaki et al. ..... 70/208
5,467,503 A * 11/1995 Nolte et al. ..... 16/429
5,551,316 A * 9/1996 Blank ..... 74/547
5,560,082 A * 10/1996 Vetter ..... 16/429
6,039,363 A * 3/2000 Sugimura et al. ..... 292/202
6,164,156 A * 12/2000 Purcell ..... 74/547
6,640,389 B2 * 11/2003 Van Klompenburg et al. . 16/429
7,147,256 B2 * 12/2006 Gill ..... 292/336.3
7,251,860 B2 * 8/2007 Liang et al. ..... 16/429
2006/0260431 A1 * 11/2006 Gill ..... 74/545

FOREIGN PATENT DOCUMENTS

DE 102 04 744 A1 8/2003
DE 10 2004 006653 A1 9/2005
EP 0 556 420 A 8/1993
GB 2 277 957 A 11/1994

OTHER PUBLICATIONS

European Search Report for EP 07016030.4, EPO, Feb. 12, 2008.

* cited by examiner

*Primary Examiner* — William L. Miller
(74) *Attorney, Agent, or Firm* — Harness, Dickey & Pierce, P.L.C.

(57) ABSTRACT

The invention relates to a rotary handle for a closing mechanism of a sash of a window, a leaf of a door, or the like, particularly a sliding sash or leaf, comprising an actuating grip, which in the neutral position can be disposed such that it is retracted in the sash or leaf at least partially with regard to the height and which can be pivoted from the neutral position in a working position as a folding grip such that it protrudes, wherein in the working position it can be rotated about a rotational axis. An operating element is provided, which is used to bring about a coupling or decoupling position in relation to a control element, which rotates together with the actuating grip in the coupling position and does not rotate along in the decoupling position.

25 Claims, 15 Drawing Sheets

ROTARY HANDLE FOR A CLOSING MECHANISM OF A SASH OF A WINDOW OR THE LIKE AND METHOD FOR ACTUATING A CLOSING MECHANISM

CROSS-REFERENCE TO RELATED APPLICATIONS

This application claims the benefit of EP 07016030, filed Aug. 15, 2007, which application is herein expressly incorporated by reference.

FIELD

The invention relates to a rotary handle for a closing mechanism of a sash of a window, a leaf of a door, or the like, particularly a sliding sash or leaf, comprising an actuating grip, which in the neutral position can be disposed such that it is retracted in the sash or leaf at least partially with regard to the height and which can be pivoted from the neutral position into a working position as a folding grip such that it protrudes, wherein in the working position it can be rotated about a rotational axis.

BACKGROUND

The statements in this section merely provide background information related to the present disclosure and may not constitute prior art.

A rotary handle of the type mentioned above is known from DE 102 04 744 A1. It comprises an actuating grip, which in the resting position rests in the associated casement or leaf in a recessed manner and can be folded out of this resting position into a working position, so that at least a region of the actuating grip protrudes from the plane of the casement or leaf. Thereafter, the actuating grip can be rotated while actuating the closing mechanism. By retracting the actuating grip, an adjoining sash or leaf can be moved past the first sash or leaf in a parallel manner at a short distance without resulting in interference with the rotary handle. A prerequisite, however, is that the rotary handle is first returned to the original rotational position while actuating the closing mechanism and is then folded into the recessed position.

SUMMARY

It is the object of the invention to create a rotary handle of the type mentioned above, which has even more diverse applications and is even less interfering.

This object is achieved according to the invention by an operating element, which brings about a coupling or decoupling position in relation to a control element, which rotates together with the actuating grip in the coupling position and does not rotate along in the decoupling position. As a result of this configuration, the actuating grip can be coupled to or decoupled from the control element in any desired rotational position, so that it can always be returned to the neutral position, which is the retracted position, regardless of the operating position of the control element effected by the rotational position. Therefore, it can be moved into the neutral position in the locked state, for example. If the sash or leaf was unlocked by bringing about the corresponding rotational position of the actuating grip, which is to say if the operating position is an unlocked position, the actuating grip can still be moved into the neutral position, which is to say the retracted position, by decoupling it from the control element remaining in the unlocked position so that also in this operating position the actuating grip does not protrude laterally from the sash or leaf in an interfering manner. The same applies to other operating positions, which may be selected by rotating the actuating grip. Due to the invention, thus the position of the control element is independent from the current position of the actuating grip.

According to a refinement of the invention, it is provided that the actuating grip comprises the operating element. Since the operating element is located on the actuating grip, particularly simple, preferably single-handed operation is possible because the operating element—if desired—can also be actuated as the actuating grip is seized.

According to a refinement of the invention, it is provided that the operating element is a sliding element. In this way, very simple actuation of the operating element by a sliding motion is possible. Preferably, the hand of the user encloses the actuating grip, wherein he can actuate the sliding element with his thumb.

It is advantageous to configure the actuating grip and/or the operating element as a manually actuatable component, or as manually actuatable components. In such a case, or in these cases, the rotary handle is then actuated manually by the user. If a motor-driven actuation is to be performed, the rotary handle can also be driven by a motor in relation to the actuating grip and/or the operating element.

According to one refinement of the invention, the operating element interacts with a swivel element, which engages in the control element in a coupling position and is disengaged from the control element in a decoupling position. Thus, by means of the operating element the position of the swivel element can be influenced such that a coupling is established between the actuating grip and the control element, so that upon rotating the actuating grip a corresponding rotational movement of the control element is performed, or that by decoupling, which is to say by actuation of the operating element such that the swivel element is disengaged from the control element, a rotational movement of the actuating grip is possible without carrying along the control element. It thus remains in the respective position. The actuating grip, however, can be returned, for example, from the working position to the neutral position and therefore has a retracted, non-interfering position.

A refinement of the invention provides that the swivel element is supported pivotably about a pivot axis. The actuating grip is preferably likewise supported foldably about this pivot axis as a folding grip. Accordingly, the pivot axis forms a common axis for the swivel element and the actuating grip.

It is advantageous to couple the operating element to a slide or to configure the element with a slide, wherein the slide interacts with the swivel element. A displacement of the slide causes the swivel element to assume the coupling position, or decoupling position.

As already mentioned above, the swivel element preferably also rotates when the actuating grip is rotated about the rotational axis thereof. If the swivel element is not coupled to the control element, the actuating grip and swivel element are rotated without the control element being rotated as well. If a coupling exists between the swivel element and control element, upon rotation of the actuating grip the control element is carried along via the swivel element.

It is preferred to bring about the coupling or decoupling position with the operating element independently from the rotational position of the actuating grip. This—as already mentioned above—results in independence of the positions from the actuating grip and control element, provided that the decoupling position is present. If the coupling position has been selected, a rotation of the actuating grip brings about a movement of the control element as well.

The control element preferably has a control pin, particularly a polygonal pin, with a square pin being preferred. It serves the non-rotatable simultaneous movement of a closing actuating element, such as a gear wheel, the teeth of which mesh with recesses of driving rods.

According to a refinement of the invention, it is provided that the control element interacts with a rotational detent position device. Due to the rotational detent positions, the control element can be perceptibly rotated into defined position, for example into a locked position and an unlocked position. These two positions can be perceived by the user due to the rotational detent position device, however they can also be overcome by applying a corresponding, slightly higher force.

A refinement of the invention is characterized by a housing, in which the actuating grip in the neutral position can be retracted at least partially with respect to the height thereof. The housing is particularly configured as a built-in housing.

As already mentioned above, the actuating grip in the neutral position is located completely or substantially retracted in the housing, particularly the built-in housing. If the actuating grip is in the working position, the longitudinal extension thereof forms an acute angle with the longitudinal extension of the housing.

Furthermore, it is advantageous to support the control element in the housing in a floating manner. In particular, it is provided that the control element is supported axially in the housing in a spring-loaded manner by means of a spring. It is preferred to provide that the spring acts between the control element and a rotary part rotatably supported in the housing. In particular, it is provided that the spring applies a force to a bearing ball, which is supported on the rotary part or on the control element. It may particularly be provided that the bearing ball with a partial ball surface rests in a bearing depression of the rotary part or control element. Based on the support of the control element in the housing described above, it is achieved in particular that tolerances, misalignment and the like can be compensated for in relation to the closing mechanism to be coupled. In particular, it is provided that the actuating grip is pivotably supported on the rotary part.

Finally, the invention relates to a method for actuating a closing mechanism of a sash of a window, a leaf of a door, or the like, particularly a sliding sash or leaf, by means of a rotary handle, which is configured particularly as described above.

Further areas of applicability will become apparent from the description provided herein. It should be understood that the description and specific examples are intended for purposes of illustration only and are not intended to limit the scope of the present disclosure.

BRIEF DESCRIPTION OF THE DRAWINGS

The drawings described herein are for illustration purposes only and are not intended to limit the scope of the present disclosure in any way.

The figures illustrate the invention based on an embodiment, wherein.

DETAILED DESCRIPTION

Figure 1:
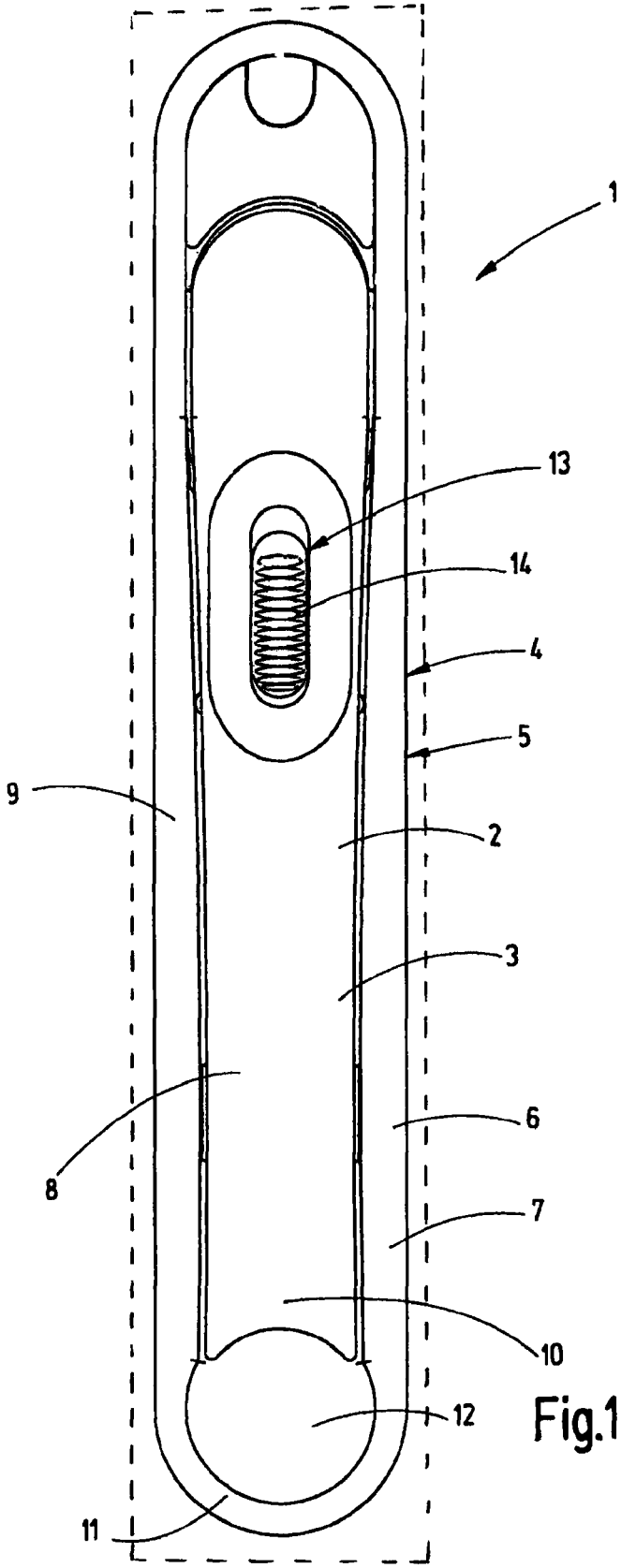
FIG. 1 is a front view of a rotary handle for a closing mechanism of a sash of a window, a leaf of a door, or the like, particularly a sliding sash or leaf.

The following description is merely exemplary in nature and is not intended to limit the present disclosure, application, or uses. It should be understood that throughout the drawings, corresponding reference numerals indicate like or corresponding parts and features.

FIG. 1 shows the front view of a rotary handle 1, by which a closing mechanism, which is not shown, of a sash of a window, or a leaf of a door, or the like, particularly a sliding sash or leaf, can be actuated. The sash or leaf is shown in FIG. 1 in broken lines. The rotary handle 1 has an actuating grip 3 configured as a folding grip 2. The rotary handle 1 comprises a housing 4, which is configured as a built-in housing 5. A front plate 6 has an overlapping edge 7 such that a retracted installation of the rotary handle 1 in a corresponding recess of the sliding sash or leaf is possible, wherein only the overlapping edge 7 is supported on the top of the sliding sash or leaf.

In FIG. 1, the folding grip 2 is in the neutral position, in which the top 8 thereof is aligned with the top 9 of the front plate 6. As is apparent from FIG. 1, the rotary handle 1 has an elongated configuration and accordingly also the actuating grip 3 has an elongated shape. The grip, however, does not extend with the lower end region 10 to the lower associated end 11 of the housing 4, so that an engaging cavity 12 is formed. The user can thus reach in the engaging cavity 12 using a finger and apply a force to the bottom and/or the lower edge region of the actuating grip 3 in order to displace it into the folded position according to FIG. 6. This folded position represents a working position. On the actuating grip 3 an operating element 13 is provided, which the user can preferably actuate using the thumb. The operating element is configured as a sliding element 14 and in FIG. 1 is in a non-effective engagement position. This engagement position is not effective because the actuating grip 3 is in the neutral position.

Figure 2:
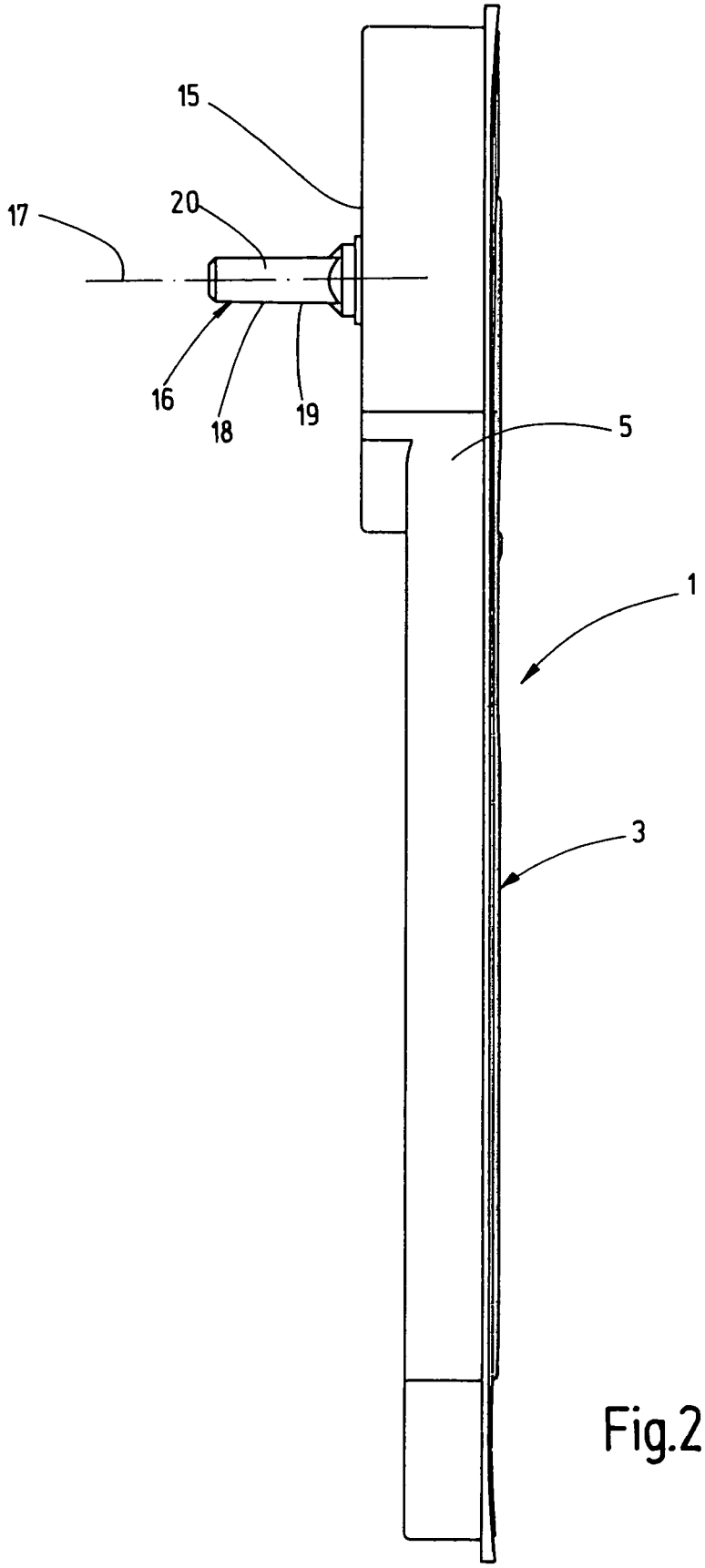
FIG. 2 is a side view of the rotary handle according to FIG. 1.

FIG. 2 shows a side view of the built-in housing 5, wherein the actuating grip 3 is in the neutral position. A control element 16 protrudes from the back 15 of the built-in housing, the element being supported rotatably about a rotational axis 17. The control element 16 preferably has a control pin 18, particularly a polygonal pin 19, preferably a square pin 20. When inserting the rotary handle 1 in the recess of the sliding sash or leaf, the control element 16 non-rotatably couples to a corresponding actuating element of a closing mechanism of the sliding sash or leaf such that a rotation of the control element brings about an actuation of the closing mechanism.

Figure 3:
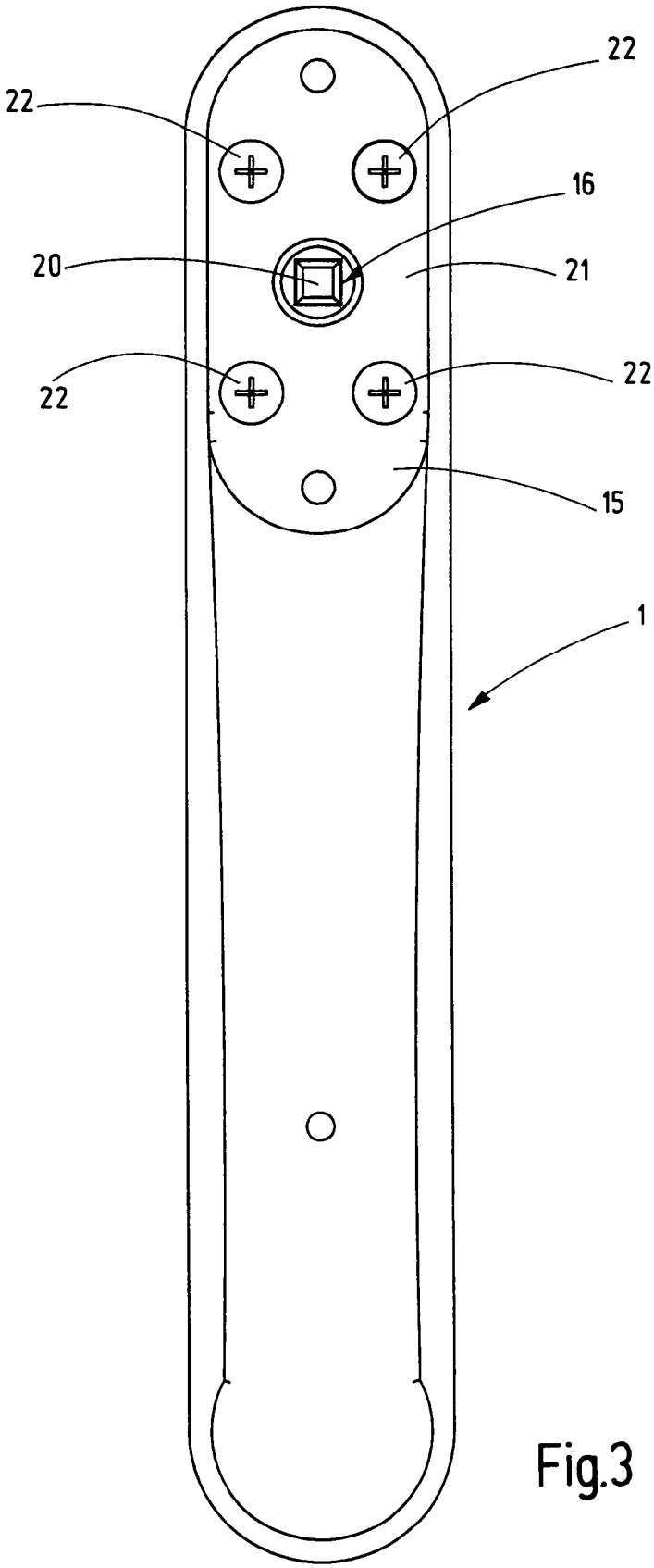
FIG. 3 is a rear view of the rotary handle according to FIG. 1.

FIG. 3 shows a rear view of the rotary handle 1. The housing 4 is closed in the upper region by a back wall 21. The back wall 21 is held by four threaded screws 22. The configuration of the control element 16 as a square pin 20 is clearly apparent from FIG. 3.

Figure 4:
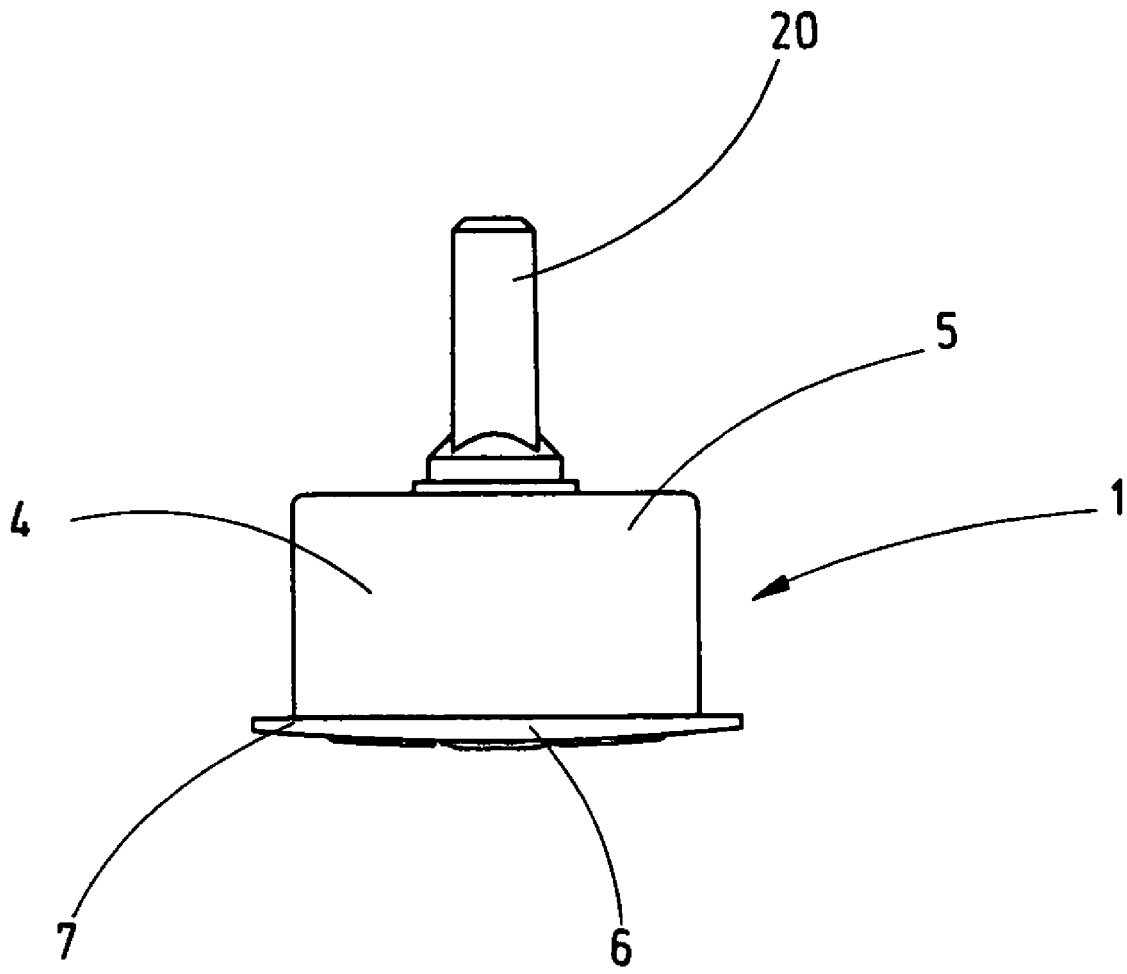
FIG. 4 is a face view from above of the rotary handle according to FIG. 1.

FIG. 4 shows a face view of the rotary handle 1.

Figure 5:
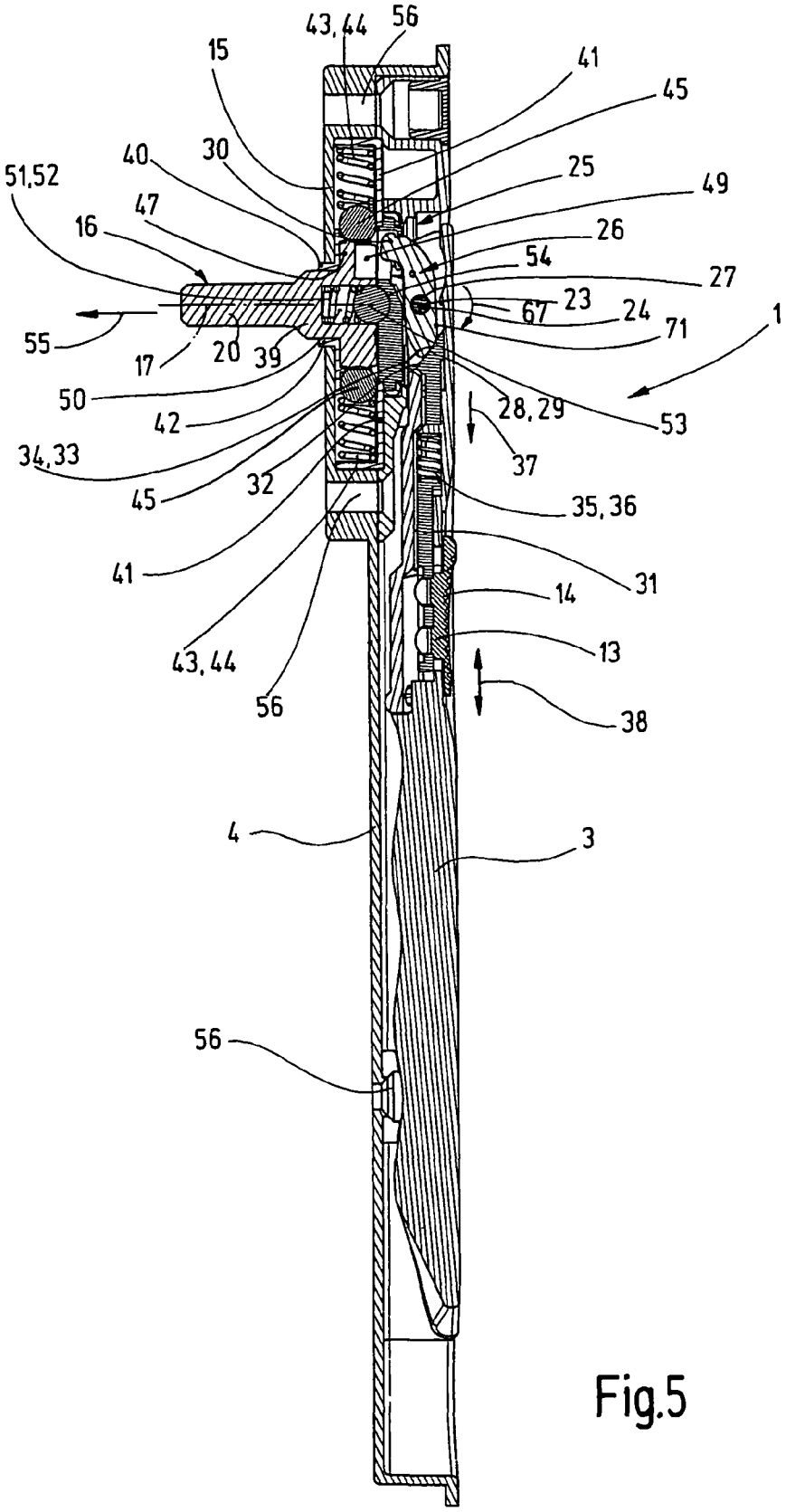
FIG. 5 is a longitudinal section of the rotary handle in the neutral position.

FIG. 5 shows a longitudinal section of the inside structure of the rotary handle 1. The actuating grip 3 can be pivoted about a pivot axis 23, which is formed by a bearing peg 24, wherein the two pivot end positions (neutral position and working position) are apparent from a comparison of FIGS. 5 and 6. The bearing peg 24 is disposed on a rotating part 25, which can be rotated about the rotational axis 17, preferably 360°. A swivel element 26 is pivotally supported about the pivot axis 23. To this end, the bearing peg 24 penetrates a receiving bore 27 of the swivel element. At a distance from the pivot axis 23, the swivel element 26 has a control surface 28, which is configured as a beveled surface 29. Facing away therefrom—opposite from the pivot axis 23—is an end 30 of the swivel element 26 for simultaneous movement. The operating element 13 configured as the sliding element 14 is coupled to a slide 31, wherein the slide 31 is supported longitudinally displaceably on the actuating grip 3 and preferably on one end 32 comprises a control surface 33, which is configured as a beveled surface 34. The slide 31 is prestressed in the direction of the operating element 13 (arrow 37) by means of a spring 35, which is configured as a helical compression spring 36. For this purpose, the helical compression spring 36 is supported both by the actuating grip 3 and by the slide 31. The operating element 13 configured as the sliding element 14 is displaceably supported on the actuating grip 3 in the direction of the double arrow 38—just as the slide 31.

The control element 16 comprises the square pin 20 mentioned above, to which a round cross-section 39 having a larger cross-section connects, which is supported rotatably about the rotational axis 17 in a bearing pot 40. The bearing pot 40 is located inside the housing 4 in a non-rotatable position. It has two diametrically opposed spring chambers 41. Furthermore, the bearing pot 40 penetrates the back 15 of the housing 4 with a pipe extension 42. In the two spring chambers 41, which are closed to the rear by the back 15 of the housing 4, springs 43 are located, which are configured as helical compression springs 44. The two helical compression springs 44 each apply a force to a detent ball 45, wherein the two detent balls 45—according to FIG. 8—can enter detent recesses 46 on the circumference of a flange 47 of the control element 16 as a function of the rotational position of the control element 16 and thereby define preferred positions of the control element 16. The flange 47 is configured substantially disk-shaped and connects to the round cross-section 39. The flange 47 at the back 48 thereof has a recess 49. From the back 48, a blind hole 50 extends coaxially to the rotational axis 17 and receives a spring 51, which is configured as a helical compression spring 52 and applies a force to a bearing ball 53, which is thereby pushed against the rotary part 25 and with a partial ball surface rests in a conforming bearing depression 54 of the rotary part 25. Due to the action of the spring force of the helical compression spring 52, the control element 16 is transferred in the direction of the arrow 55 (FIG. 5). It rests—depending on the operating state—with the flange 47 thereof on the bearing pot 40 and pushes the same likewise in the direction of the arrow 55 so that it is pressed against the inside of the back 15 of the housing 4. From all this it is apparent that the control element 16 is supported in the housing 4 to a certain degree in a floating manner, so that potentially present tolerances, positional errors and misalignment with respect to the coupling to the aforementioned closing mechanism occurring by means of the square pin 20 can be compensated for.

Due to three fastening bores 56, the housing 4 configured as a built-in housing 5 can be fastened in the retracted position to the sliding sash or leaf mentioned above by means of suitable fastening screws. "Retracted position" shall mean that the top of the front plate 6 is aligned, or substantially aligned, with the corresponding surface of the sliding sash or leaf.

Figure 8:
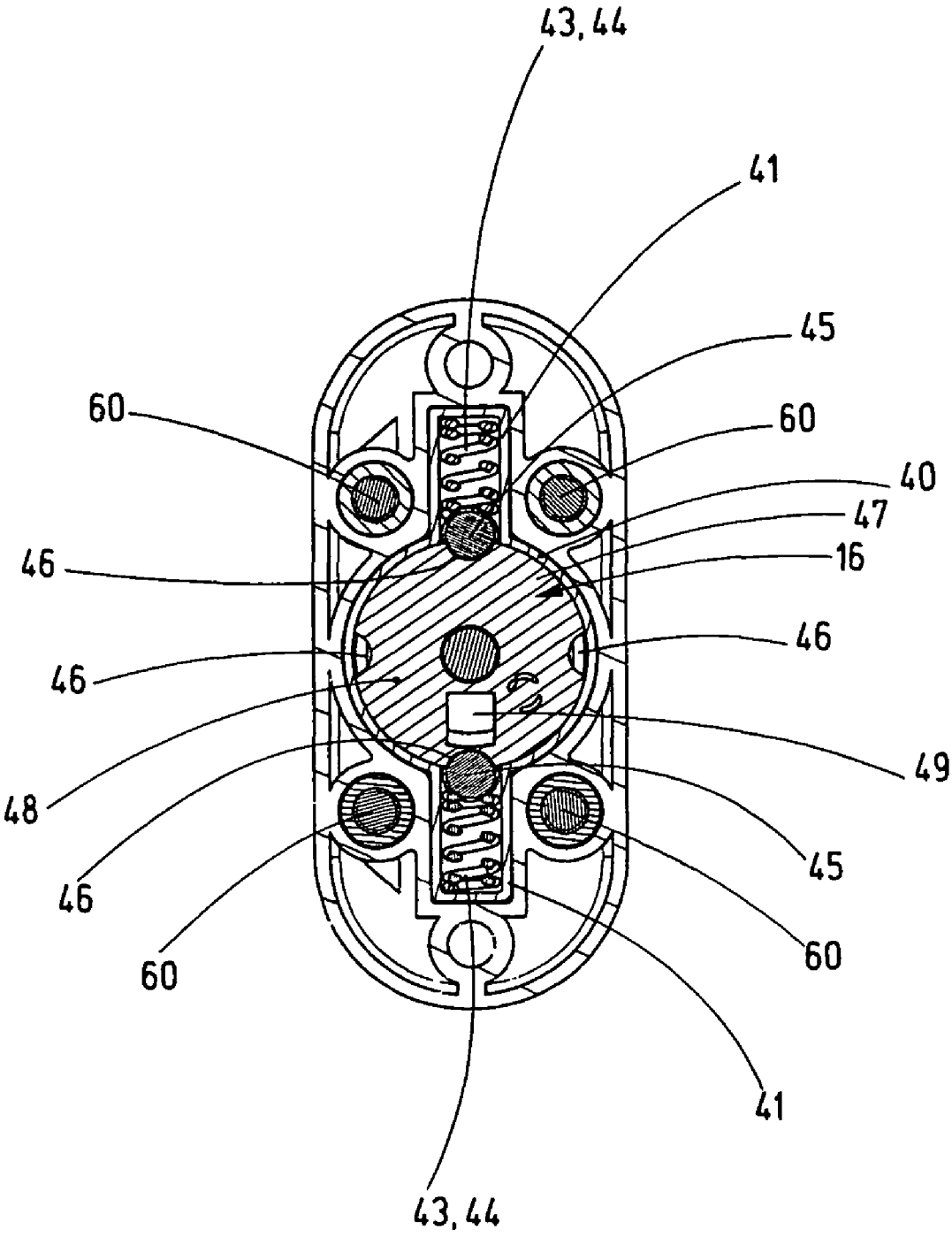
FIG. 8 is a longitudinal section of the rotary handle in the region of a control element of the rotary handle.
Figure 9:
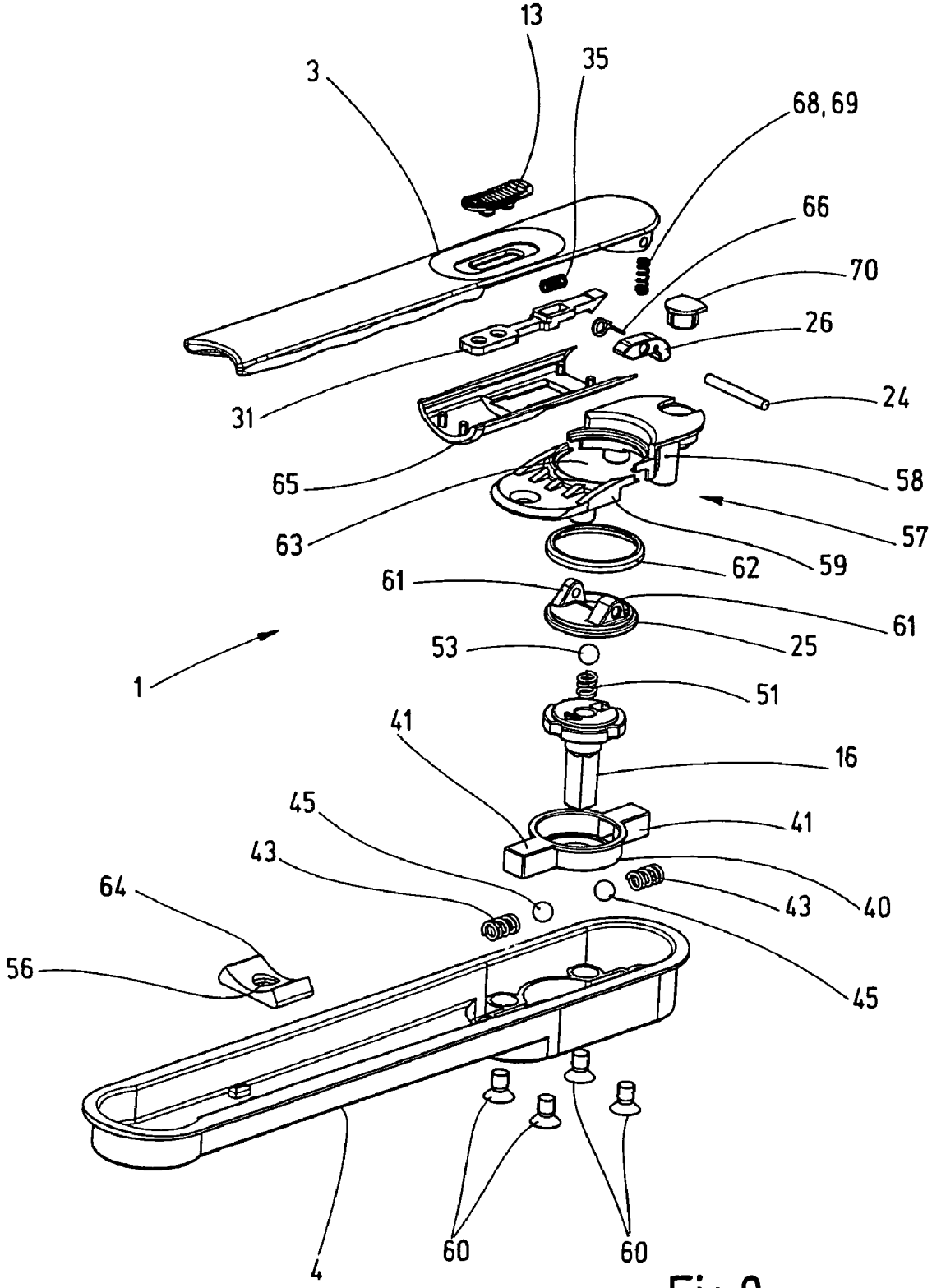
FIG. 9 is an exploded view of the rotary handle.

According to FIGS. 8 and 9, an inner bearing part 57 is located inside the housing 4, the part being made of a first bearing part 58 and a second bearing part 59 and screwed to the housing 4 by means of four threaded screws 60.

The design of the rotary handle 1 is particularly apparent from the exploded view of FIG. 9. It shows, among other things, that the rotary part 25 comprises bearing blocks 61, which the bearing peg 24 penetrates. A friction ring 62 receives the edge of the rotary part 25 and supports the rotary part 25 in a receptacle 63 of the inner bearing part 15. One of the fastening bores 56 is configured in an insert part 64, which can be inserted in the housing 4. The slide 31 is held on the actuating grip 3 by means of a back cover 65. The rocker-like swivel element 26 is associated with a spring 66, which according to arrow 67 in FIG. 5 rotates the swivel element 26 clockwise about the pivot axis 23, whereby the control surfaces 28 and 33 move on top of each other. A spring 68, which is configured as a helical compression spring 69, applies a force to the back of the actuating grip 23 by being appropriately supported on an inside surface of the housing 4 such that the actuating grip 3 is pushed about the pivot axis 23 in the direction of the neutral position according to FIG. 5. The associated fastening bore 56 can be covered by means of a clip-like screw head cover 70.

Figure 6:
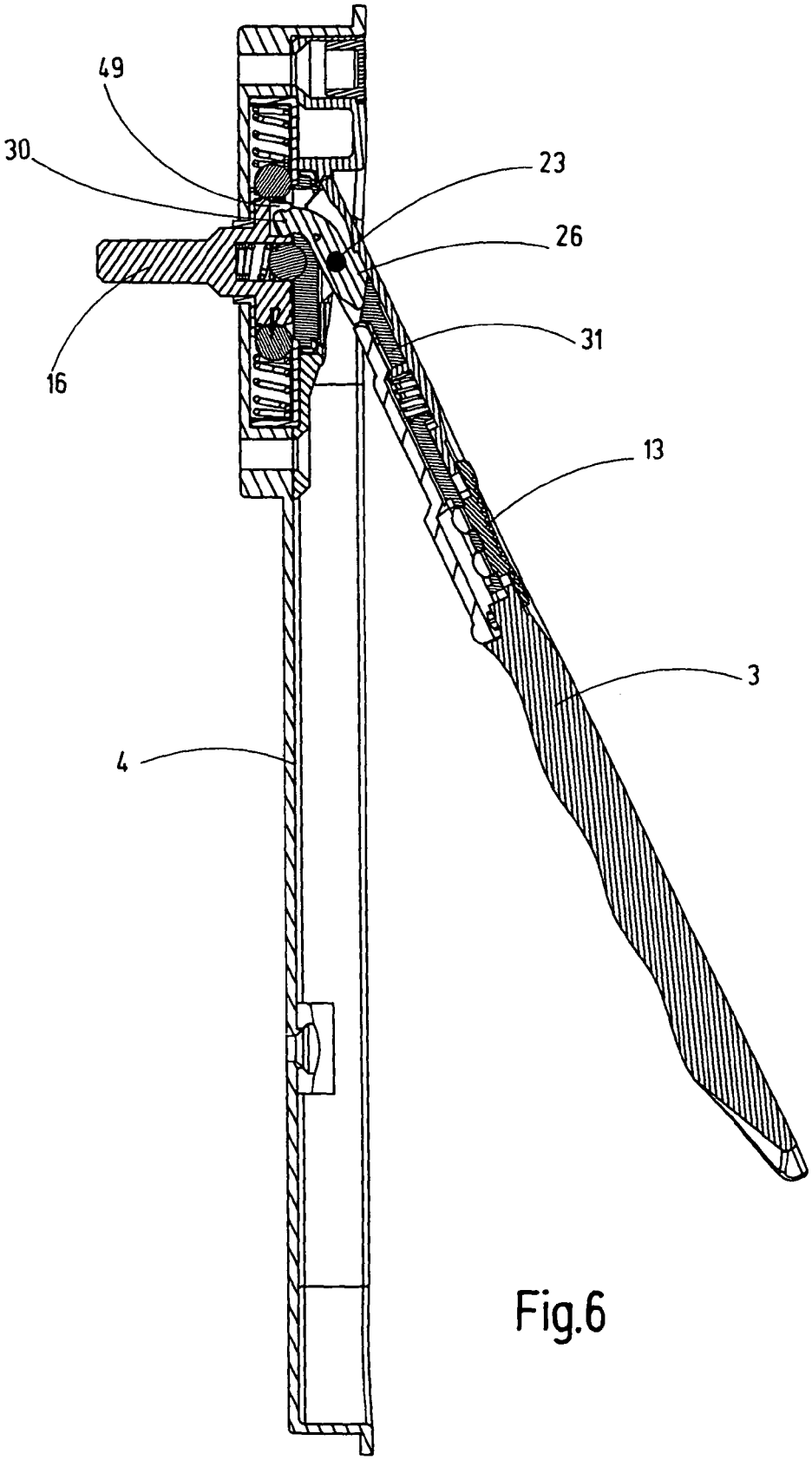
FIG. 6 is a longitudinal section of the rotary handle in the working position.

This configuration produces the following function: If the rotary handle 1 according to FIG. 5 is in the neutral position, which is to say the actuating grip 3 is folded in, the rotary handle in this state is aligned with the sliding sash of a window, or leaf of a door, or the like, in which it is installed in a retracted manner. Since no part of the rotary handle protrudes, the sliding sashes or leaves of multi-sash or multi-leaf arrangements can be positioned very close adjacent to each other and slid past each other, without resulting in any interference of the rotary handle with the passing sash or leaf. If the associated closing mechanism is to be actuated by means of the rotary handle, the user reaches in the engaging cavity 12 with a finger and pivots the actuating grip 3 into the working position, which is apparent from FIG. 6. FIG. 6 also shows that by pivoting the actuating grip 3 about the pivot axis 23, the end 30 of the swivel element 26 for simultaneous movement enters the recess 49 of the control element 16. In this way, a rotary coupling is created between the actuating grip 3, which is supported rotatably about the rotational axis 17 by means of the rotary part 25, and the control element 16. FIG. 6 shows that in this situation the operating element 13 assumes a position that is supported by the spring 35, wherein as a result of the displacement of the actuating grip 3 from the neutral position to the working position the slide 31 shifts the swivel element 26 such that is couples with the control element 16.

Figure 10:
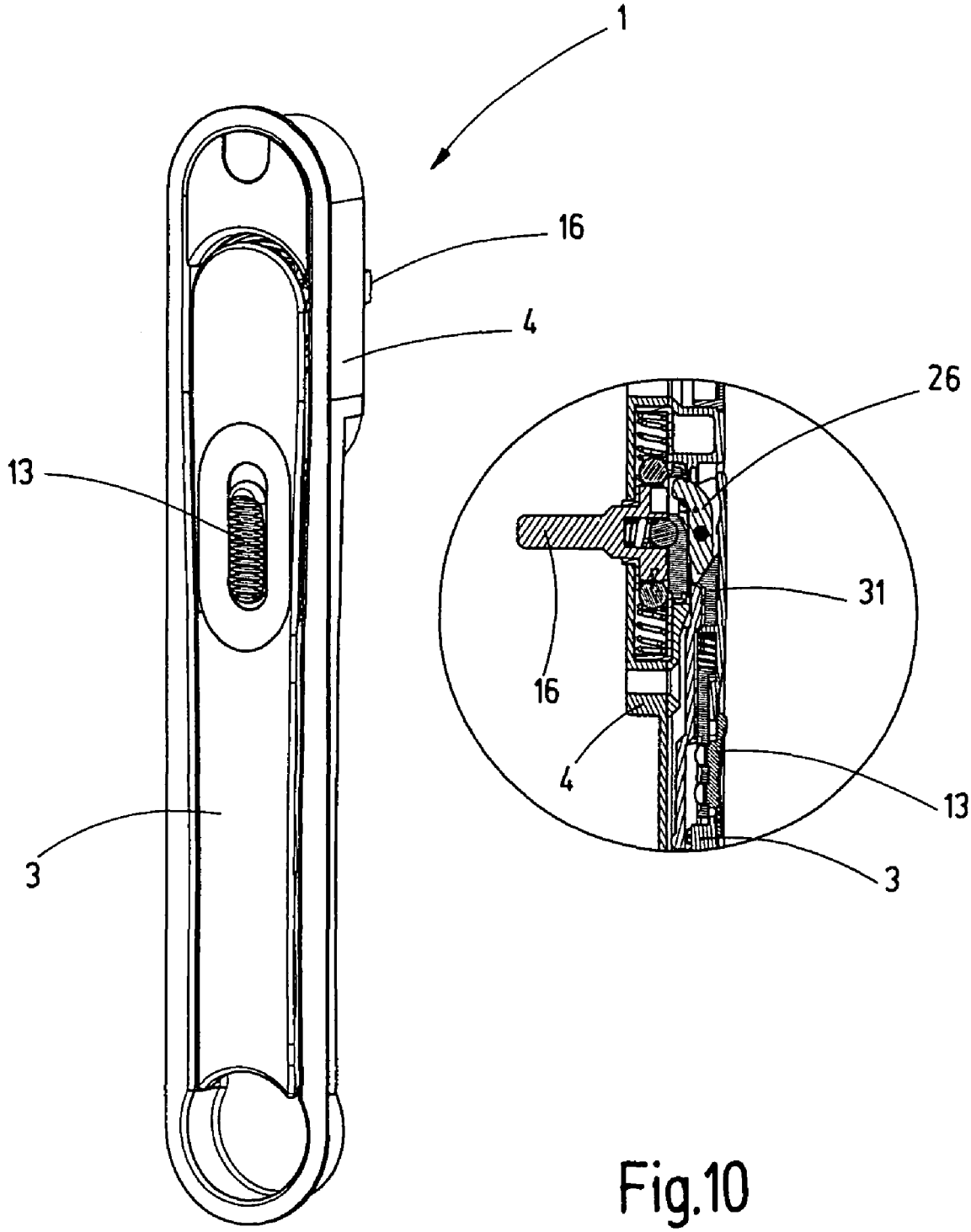
FIG. 10 is a perspective view of the rotary handle and a partial longitudinal section of the rotary handle, each in the neutral positions, FIG. 11 are illustrations corresponding to FIG. 10, however in the working positions, with the actuating grip not rotated, FIG. 12 are illustrations corresponding to FIG. 11, however with the actuating grip rotated, FIG. 13 are illustrations corresponding to FIG. 12, however after actuating an operating element provided on the actuating grip, FIG. 14 are illustrations corresponding to FIG. 12, however with a rotation of the actuating grip by 180°, FIG. 15 are illustrations corresponding to FIG. 14, however with the operating element being actuated.

The situation according to FIG. 5 is again shown in a perspective top view and partial sectional view in FIG. 10.

Figure 7:
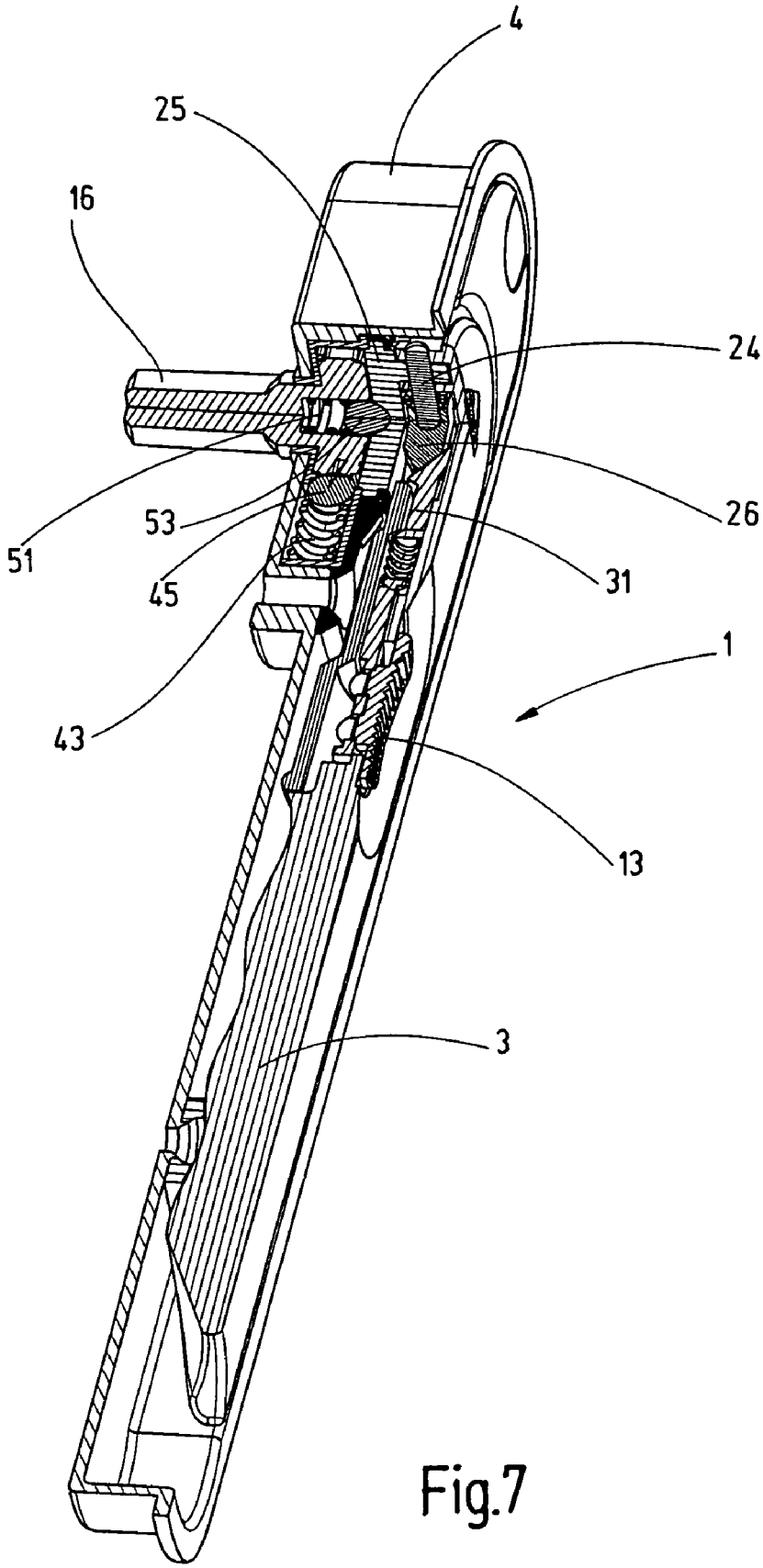
FIG. 7 is a perspective view of the rotary handle in a partially cut view.
Figure 11:
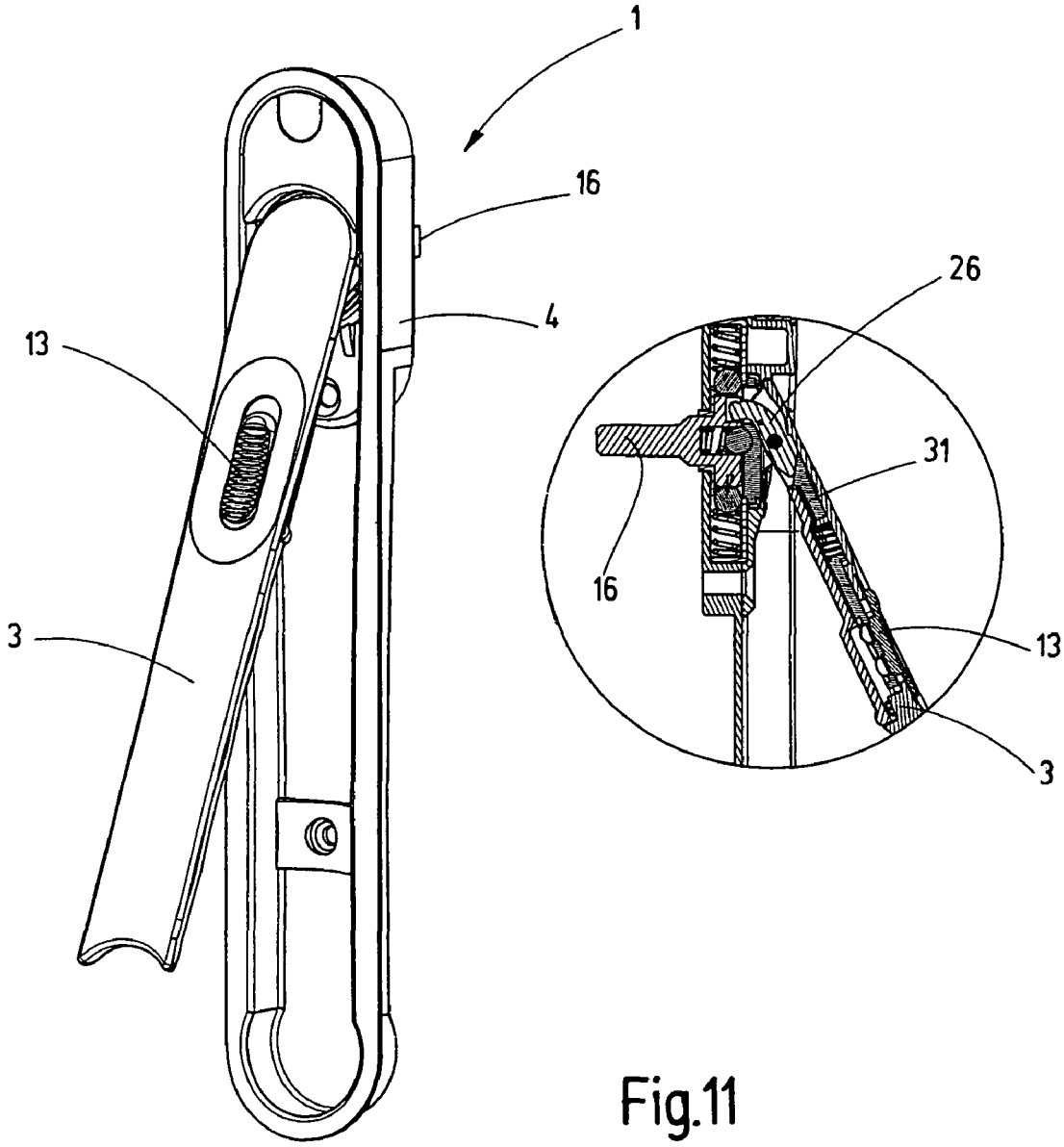

The situation according to FIG. 6 is likewise shown in a perspective view and partial sectional view in FIG. 11. FIG. 7 illustrates the inside design of the rotary handle 1 based on a partially cut perspective illustration of the rotary handle 1. The actuating grip 3 is in the neutral position in this example.

Figure 12:
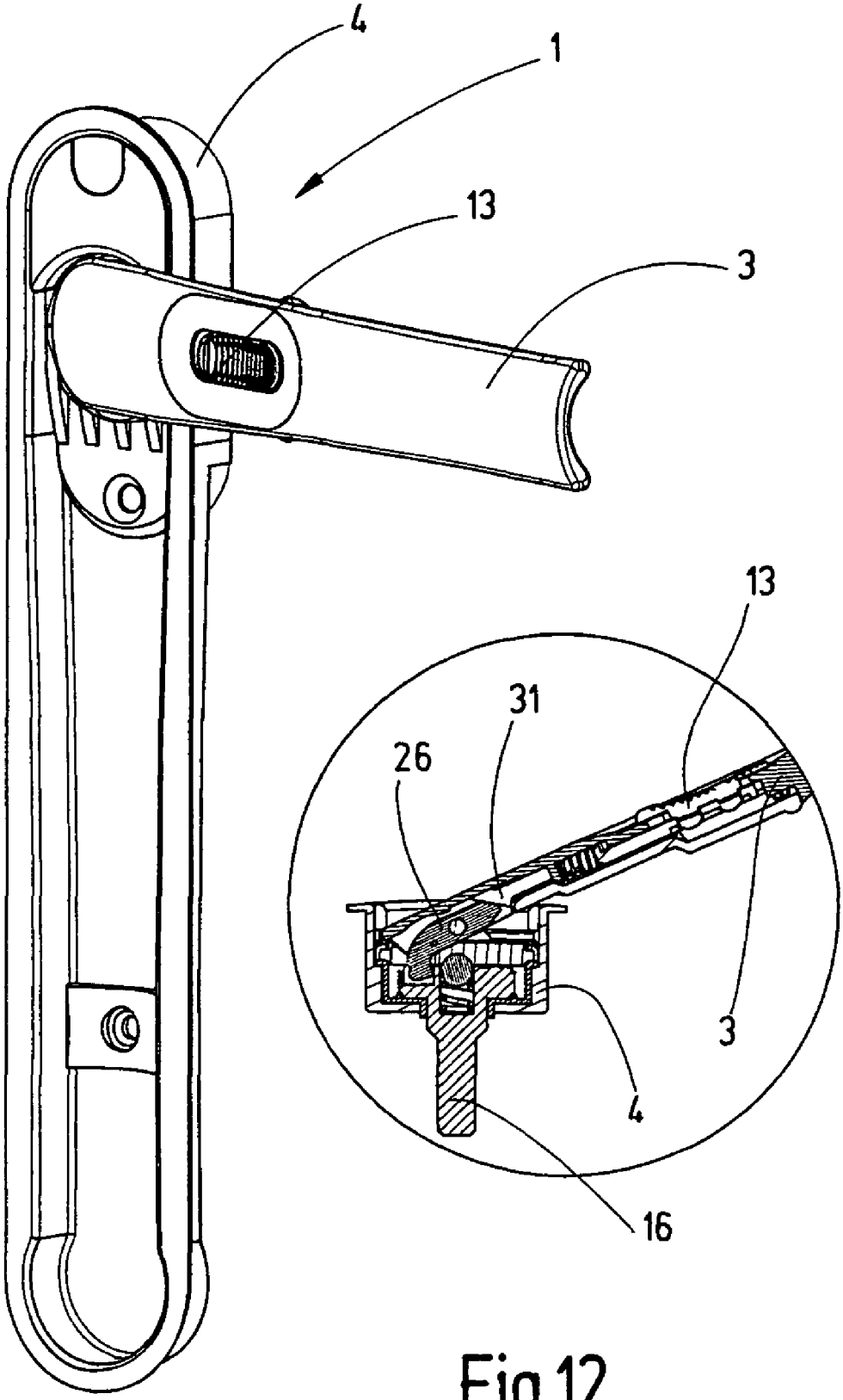

FIG. 12 shows a rotated position of the actuating grip 3 of the rotary handle 1, which can be brought about from the situation according to FIG. 11. For this purpose, the user—starting from the situation according to FIG. 11—rotates the actuating pin 3 about the rotational axis 17. The swivel element 26 carries the control element 16 along, so that by means of the square pin 20 a closing mechanism of the sash or leaf can be actuated. For example, in this way the closing mechanism can be displaced from the locked position to the unlocked position. It is now possible, for example, to displace the sliding sash or leaf from a closed position to an open position. In order to eliminate any interfering protrusion of the actuating grip 3 from the housing 4, it is possible now—according to FIG. 13—by actuating the operating element 13 to displace the slide 31 such that the control surface 33 thereof leaves the control surface 28 of the swivel element 26 and applies a force to an abutting actuating surface 71 of the swivel element 16 such that it pivots about the bearing peg 24 against the action of the spring 66, whereby the end for simultaneous movement 30 exits the recess 49 of the control element 16 and therefore no coupling exists any longer between the actuating grip 3 and the control element 16. It is thus possible to displace the actuating grip 3 into the position according to FIG. 11 and fold it into the position according to FIG. 10, without modifying the position of the control element 16. As a result, no interfering elements protrude laterally from the sash or leaf, and therefore an adjacent sash or leaf, for example, can be moved past the sash or leaf at a very close distance.

Figure 14:
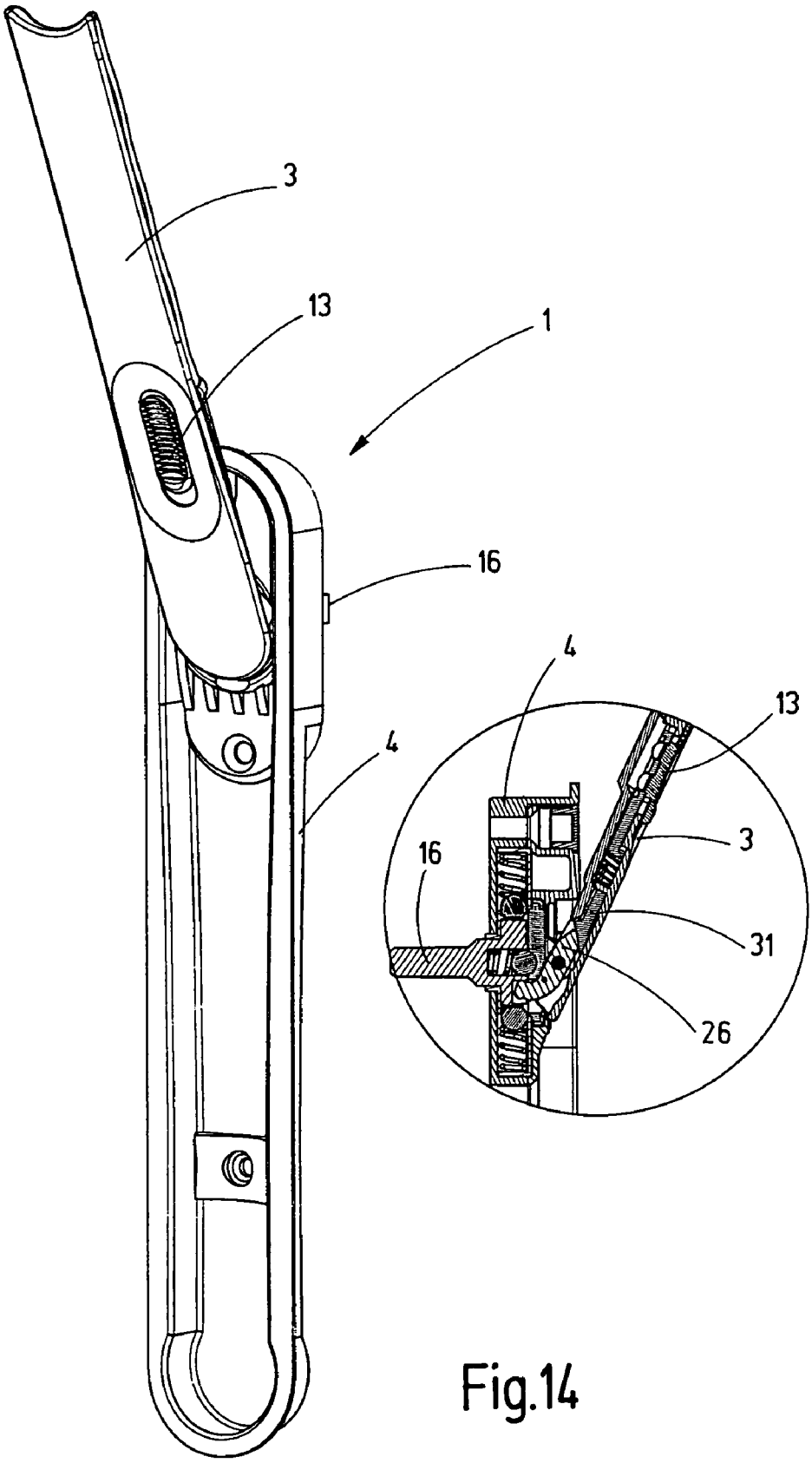
Figure 15:
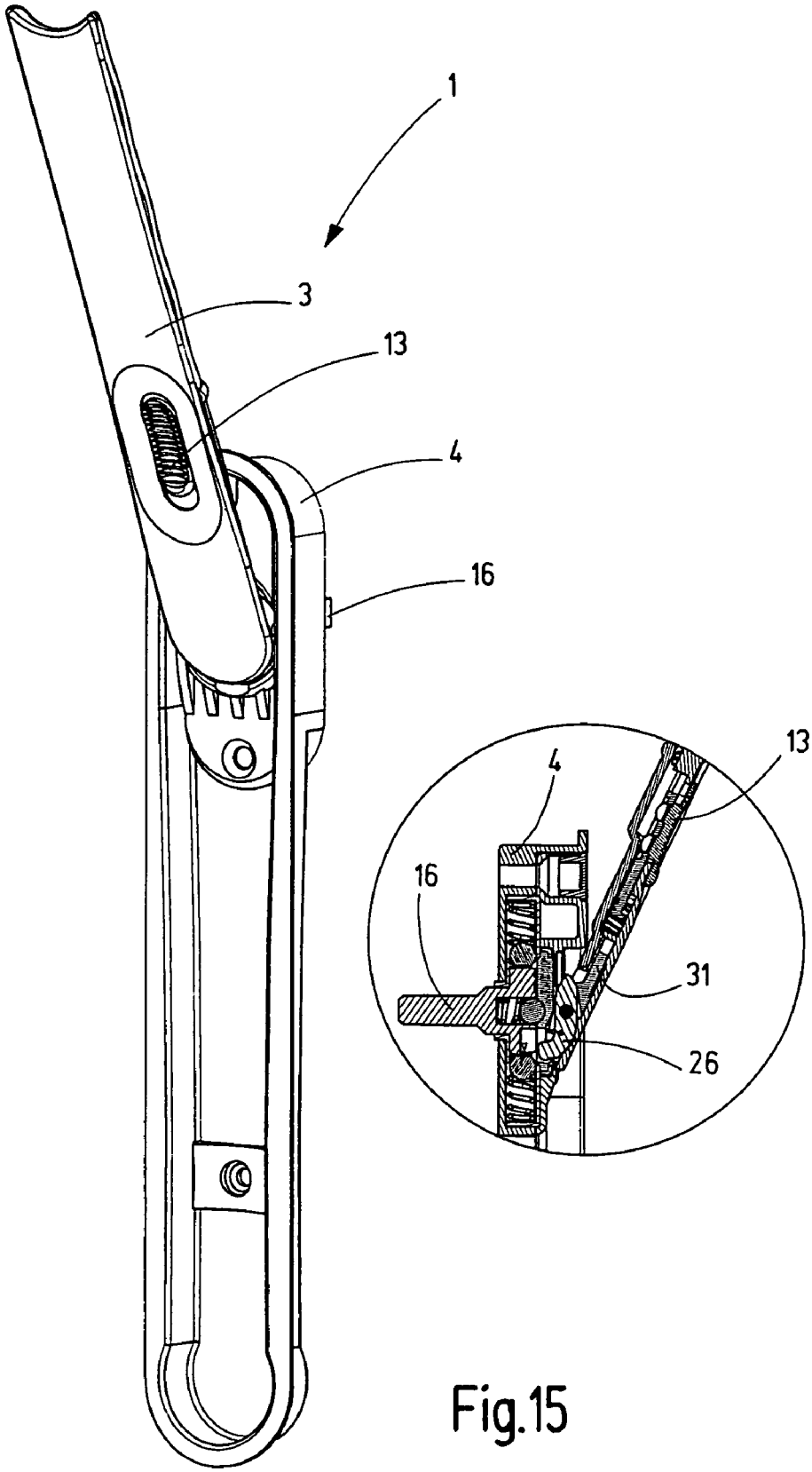

According to FIG. 14 it is also possible to perform not only a 90° rotation of the actuating grip 3 and the control element 16, but also a 180° rotation, for example. Also in the position according to FIG. 14, decoupling of the actuating grip 3 from the control element 16 can be performed by operating the operating element 13. The operating element 13 is preferably actuated by the thumb of the user. From the position according to FIG. 15, the actuating grip 3 can be returned to the position according to FIG. 10 without displacing the control element 16 from the 180° rotational position. Of course other rotational angles can be implemented as well. The different rotational angles are preferably identified by slight detent actions of the detent balls 15, which can enter accordingly provided detent recesses 46 of the flange 47 of the control element 16.

Figure 13:
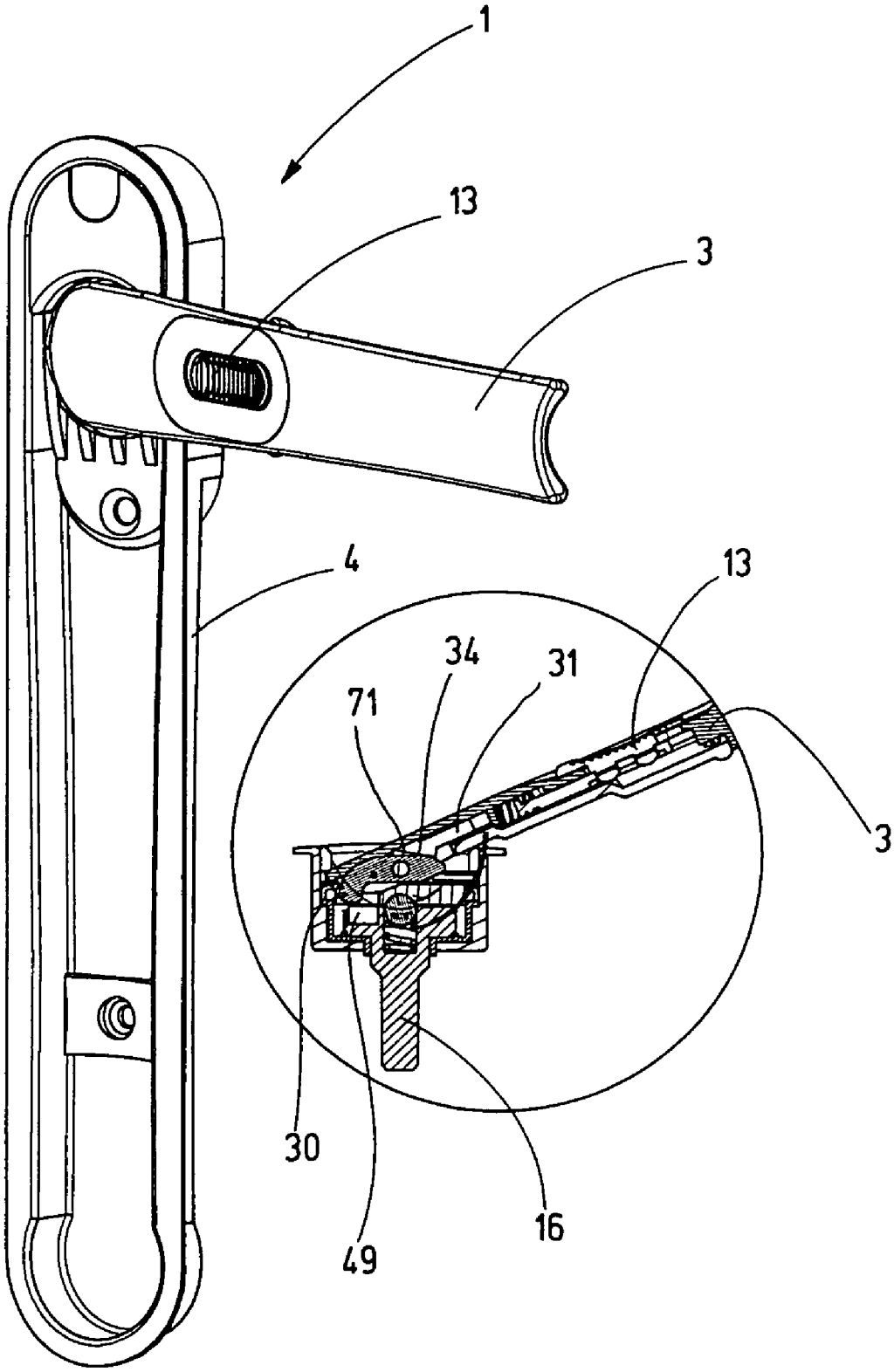

If the sliding sash or leaf is to be locked again by an appropriate actuation of the closing mechanism, the actuating grip 3 is first displaced from the position according to FIG. 10 into the position according to FIG. 11, with the operating element 13 actuated, then—with a 90° rotation—rotated into the position according to FIG. 13, then the coupling position with the control element 13 is brought about by actuating the operating element 13, and finally, while carrying along the control element 16, it is moved to the position according to FIG. 11 and then pivoted into the neutral position according to FIG. 10.

What is claimed is:

1. A rotary handle for a closing mechanism of a sliding window sash or a sliding door leaf, the rotary handle comprising:

an actuating grip, which in a neutral position is disposed such that it is retracted in the sash or leaf at least partially with regard to a height and which is pivoted from the neutral position into a working position as a folding grip such that it protrudes, and which in the working position is rotated about a rotational axis; and an operating element for bringing about a coupling or decoupling position in relation to a control element, the operating element rotates together with the actuating grip in the coupling position and does not rotate along in the decoupling position;

wherein the operating element interacts with a swivel element, which engages the control element in a coupling position and is disengaged from the control element in a decoupling position.

2. The rotary handle according to claim 1, wherein the actuating grip comprises the operating element.

3. The rotary handle according to claim 1, wherein the operating element is a sliding element.

4. The rotary handle according to claim 1, wherein at least one of the actuating grip and the operating element is a manually actuatable component.

5. The rotary handle according to claim 1, wherein the swivel element is pivotably supported about a pivot axis.

6. The rotary handle according to claim 5, wherein the actuating grip is foldably supported about the pivot axis as a folding grip.

7. The rotary handle according to claim 5, wherein the operating element is coupled to a slide, or comprises the slide, the slide interacting with the swivel element.

8. The rotary handle according to claim 1, wherein the control element has a recess, into which the swivel element enters in order to bring about the coupling position and from which the swivel element exits in order to bring about the decoupling position.

9. The rotary handle according to claim 1, wherein the swivel element rotates along if the actuating grip is rotated about a rotational axis thereof.

10. The rotary handle according to claim 1, wherein the operating element is used to bring about the coupling or decoupling position independently from a rotational position of the actuating grip.

11. The rotary handle according to claim 1, wherein the control element comprises a control pin, particularly a polygonal pin.

12. The rotary handle according to claim 1, wherein the control element interacts with a rotational detent position device.

13. The rotary handle according to claim 1, further comprising a housing in which the actuating grip in the neutral position is retracted at least partially with respect to the height thereof.

14. The rotary handle according to claim 13, wherein the actuating grip forms an acute angle with the housing in the working position.

15. The rotary handle according to claim 13, wherein the housing is a built-in housing.

16. The rotary handle according to claim 13, wherein the control element is supported in the housing in a floating manner.

17. The rotary handle according to claim 13, wherein the control element is supported axially in the housing in a spring-loaded manner by a spring.

18. The rotary handle according to claim 17, wherein the spring acts between the control element and a rotary part rotatably supported in the housing.

19. The rotary handle according to claim 18, wherein the spring applies a force to a bearing ball, which is supported on the rotary part or on the control element.

20. The rotary handle according to claim 19, wherein the bearing ball has a partial ball surface that rests in a bearing depression of the rotary part or control element.

21. The rotary handle according to claim 18, wherein the actuating grip is pivotably supported on the rotary part.

22. A method for actuating the closing mechanism of the rotary handle of claim 1, comprising: activating the actuating grip.

23. A rotary handle for a closing mechanism of a sliding window sash or a sliding door leaf, the rotary handle comprising:

an actuating grip, which in a neutral position is disposed such that it is retracted in the sash or leaf at least partially with regard to a height and which is pivoted from the neutral position into a working position as a folding grip such that it protrudes, and which in the working position is rotated about a rotational axis; and an operating element which is used to bring about a coupling or decoupling position in relation to a control element, which rotates together with the actuating grip in the coupling position and does not rotate along in the decoupling position;

wherein the control element interacts with a rotational detent position.

24. A rotary handle for a closing mechanism of a sliding window sash or a sliding door leaf, the rotary handle comprising:

an actuating grip, which in a neutral position is disposed such that it is retracted in the sash or leaf at least partially with regard to a height and which is pivoted from the neutral position into a working position as a folding grip such that it protrudes, and which in the working position is rotated about a rotational axis; and an operating element which is used to bring about a coupling or decoupling position in relation to a control element, which rotates together with the actuating grip in the coupling position and does not rotate along in the decoupling position;

further comprising a housing in which the actuating grip in the neutral position is retracted at least partially with respect to the height thereof; and wherein the control element is supported in the housing in a floating manner.

25. A rotary handle for a closing mechanism of a sliding window sash or a sliding door leaf, the rotary handle comprising:

an actuating grip, which in a neutral position is disposed such that it is retracted in the sash or leaf at least partially with regard to a height and which is pivoted from the neutral position into a working position as a folding grip such that it protrudes, and which in the working position is rotated about a rotational axis; and an operating element which is used to bring about a coupling or decoupling position in relation to a control element, which rotates together with the actuating grip in the coupling position and does not rotate along in the decoupling position;

further comprising a housing in which the actuating grip in the neutral position is retracted at least partially with respect to the height thereof; and wherein the control element is supported axially in the housing in a spring-loaded manner by a spring.

* * * * *